US005465694A

United States Patent [19]

Agarrat

[11] Patent Number: 5,465,694

[45] Date of Patent: Nov. 14, 1995

[54] V-BLOCK ENGINE LUBRICATION DEVICE

[76] Inventor: Stanley A. Agarrat, 3660 NW. 17 St., Ft. Lauderdale, Fla. 33311

[21] Appl. No.: 408,374

[22] Filed: Mar. 22, 1995

[51] Int. Cl.[6] ..... F01M 11/02

[52] U.S. Cl. ..... 123/196 R; 184/6.5

[58] Field of Search ..... 123/196 R, 196 M; 184/6.5

[56] References Cited

U.S. PATENT DOCUMENTS

| | | | |
|---|---|---|---|
| 2,907,411 | 10/1959 | Leach | 123/196 R |
| 2,983,335 | 5/1961 | Etchells et al. | 123/196 R |
| 4,512,298 | 4/1985 | Hayashi | 123/196 R |
| 4,852,534 | 8/1989 | Amaral | 123/196 R |

FOREIGN PATENT DOCUMENTS

| | | | |
|---|---|---|---|
| 212981 | 3/1987 | European Pat. Off. | 123/196 R |

*Primary Examiner*—Henry C. Yuen
*Assistant Examiner*—Erick Solis
*Attorney, Agent, or Firm*—Malin, Haley DiMaggio & Crosby

[57] ABSTRACT

An improved lubrication circuit for a V-block, cam in block, General Motors type internal combustion engine. The improvement is provided by forming additional oil passages in the V-block between the left side oil passage and some of the cam bearings. The cam bearings corresponding to the new oil passages are rotated to match their oil lubrication ports to the new oil passages to allow lubrication of those bearings by oil supplied by the left side oil passage. The improvement reduces the load requirements of the right side oil passage and increases the oil flow in the left side oil passage. The improvement results in: engine operation at a more balanced temperature; reduced frictional losses; improved high speed lubrication; improved idle speed oil pressure; improved engine life; and improved fuel efficiency.

2 Claims, 2 Drawing Sheets

V-BLOCK ENGINE LUBRICATION DEVICE

BACKGROUND OF THE INVENTION

1. Field of the Invention

This invention relates generally to a V-block internal combustion type engine lubrication circuit and specifically, to an improved V-block engine lubrication circuit device for a V-block, cam in block, General Motors type engine.

2. Description of Related Art

Lubrication of cam bearings and main or crankshaft bearings in a conventional 90 degree V-block, cam in block, General Motors engine is well known in the art. Lubrication is accomplished by oil being supplied to the cam bearings from the oil pump via an oil supply passage on the right side of the engine. Some of the oil from the right side oil passage is directed, by intersecting oil passages, to the crankshaft, or main bearings to provide for their lubrication. In addition, the oil passage on the right side provides lubrication for the lifters on the right side of the engine.

Along with the oil passage on the right side of the engine, the oil pump simultaneously supplies oil to an oil supply passage on the left side of the engine. The left side passage supplies oil for the lifters on the left side of the engine. The oil pump also supplies oil to the first cam bearing and the first crankshaft bearing which are physically located closest to the oil pump.

With the exception of the first bearings, the right side oil passage provides oil for all cam bearings, crankshaft bearings and right side lifters. The right side oil passage has a continuous flow of oil through the passage. The continuous flow of oil on the right side removes heat from that side of the engine.

The left side passage has very little flow because it is plugged at the end farthest from the oil pump and only supplied oil to the left side lifters. The lifters do not require as much oil as the bearings and, with the exception of seeping necessary for lifter lubrication, the oil in the left side passage lies stagnant. Without continuous flow, the oil on the left side of the engine becomes hotter than the oil on the right side of the engine. This results in a heat imbalance in the engine, with the left side running hotter than the right side. The heat imbalance causes uneven wear and premature failure of the bearings and other moving parts of the engine.

Other engine problems are caused by the lubrication of the cam and crankshaft bearings being supplied solely from the right side oil passage. For example, a car with an automatic transmission at normal highway speeds or moderate road speed the converter locks up and puts pressure on the thrust bearing. The transmission then goes into overdrive which reduces the engine RPM which in turn reduces oil flow and oil pressure. With insufficient oil at this critical stage, the thrust bearing wears.

The front end of the right side oil passage terminates in a plug that infringes the passage enough to aide in high speed oil starvation experienced by components supplied by the right side oil passage.

Having a single oil passage supply the cam and crankshaft bearings also results in a drop in oil pressure at idle speeds. The bearings are not supplied with sufficient lubrication at idle speed and results in increased friction causing premature bearing wear. This is most critical when returning to idle from highway driving as when paying a toll. Oil at this stage is at its least viscosity and engine component wear is at its greatest because the engine is at its hottest temperature.

Contributing to these problems is the fact that two crankshaft bearings supply oil to multiple return oil passages whereas the other two crankshaft bearings supply oil to one oil return passage. This results in two of the four crankshaft bearings requiring more oil than the other two. When all the crankshaft bearings are supplied by the right side oil passage two of the four bearings do not receive sufficient oil under all operating conditions.

SUMMARY OF THE INVENTION

This invention is directed at solving the above mentioned problems by improving the lubrication circuitry in a conventional 90 degree V-block General Motors type engine. The improvement is accomplished by modification of the lubrication circuitry of an existing V-block engine to the semi-ring circuit of the instant invention. The modification comprising new apertures in the V-block to direct oil from the left side oil passage to some of the cam bearings. The bearings associated with the new apertures are rotated to receive the oil now being supplied from the left side oil passage. The oil previously supplied to the rotated bearings from the right side oil passage now flows by and cools those bearings and continues to supply oil to the associated crankshaft bearings.

The present invention insures that the right side oil passage continues to supply oil to the right side lifters and crankshaft bearings, but fewer cam bearings. This reduces the overall oil supply load requirements on the right side oil passage providing more oil supply under all operating conditions to the components still being lubricated by this oil passage. Reducing the load requirements on the right side oil passage results in better oil pressure at idle speed thus reducing friction, extending bearing life, and reducing the oil starvation problem at high speeds.

The present invention further results in the left side oil passage supplying oil to the left side lifters and some of the cam bearings. The increased flow requirements of the left side oil passage produces continuous oil flow which provides for better heat removal. The left side of the engine now runs cooler and the engine operates at a balanced temperature.

The improvement in frictional losses and temperature balance increases the life of the engine and improves fuel efficiency.

Based on the above, it is an objective of the instant invention to extend bearing life due to more uniform heat dissipation.

It is a further objective to improve oil pressure at idle speeds.

It is a further objective to stop premature engine failure due to inadequate oil supply.

It is a further objective to seek an improvement in frictional losses.

In accordance with these and other objects which will become apparent hereinafter, the instant invention will now be described with particular reference to the accompanying drawings.

DESCRIPTION OF THE PREFERRED EMBODIMENT

The detailed description of the invention is made using a representative six cylinder 90 degree V-block, cam in block, General Motors engine as an example. The example is not intended to restrict the invention to a six cylinder engine. It is contemplated that the invention can be practiced in other 60 or 90 degree V-block, cam in block, type engines with other than six cylinders.

Figure 1:
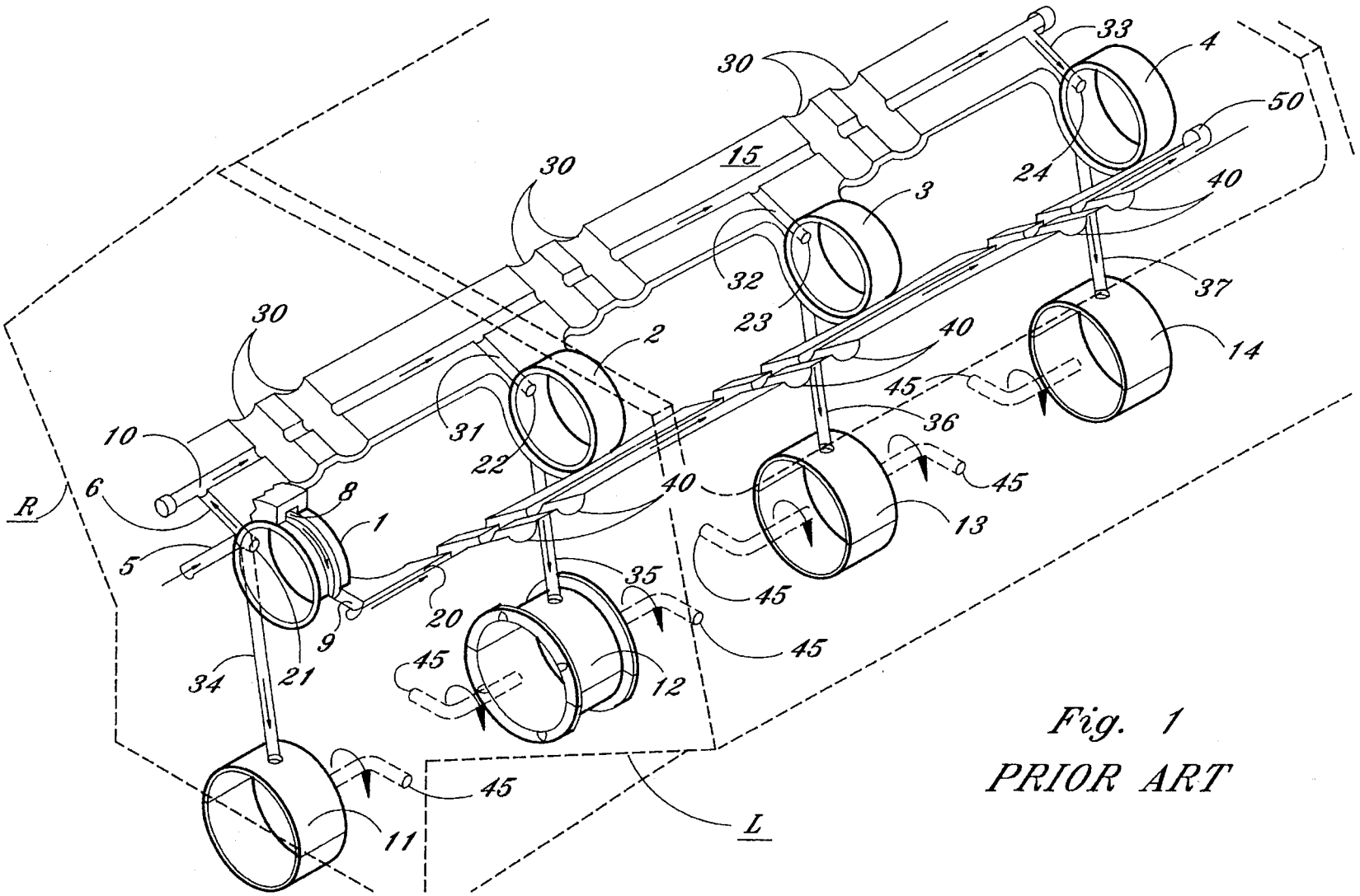
Fig. 1 PRIOR ART
FIG. 1 is a perspective view of the lubrication circuit for a representative six cylinder 90 degree V-block, cam in block, General Motors internal combustion engine.

The lubrication circuit prior to modification can be seen in FIG. 1. The oil pump (not shown) supplies pressurized oil to the right side oil passage 10 through inlet oil passage 5 and oil passage 6. Oil passage 10 extends substantially the entire length of engine V-block 15, on the right side R, and supplies oil to oil passages 31, 32, and 33 and to right side lifter bores 30. Oil passages 10, 5, 6, 31, 32, and 33 consist of bores formed in engine V-block 15.

The oil pump simultaneously supplies oil to the left side oil passage 20 through inlet passage 5, radial oil passage groove 8, and oil passage 9. Oil passage 20 extends for substantially the entire length of engine V-block 15, on the left side L, and supplies oil to left side lifter bores 40. The end of left side oil passage 20, farthest from the inlet oil passage 5, is terminated in a cap or plug 50. Oil passage 20 and 9 consist of bores formed in engine V-block 15.

The oil pump also supplies oil to cam bearing 1 through inlet passage 5 via port 21. Cam bearings 2, 3, and 4 are supplied oil from right side oil passage 10 through ports 22, 23, and 24 respectively via oil passages 31, 32, and 33 respectively.

The oil pump further supplies oil to crankshaft or main bearing 11 via oil passage 34 and inlet oil passage 5. Crankshaft bearings 12, 13, and 14 are supplied oil from right side oil passage 10, through oil passages 35, 36, and 37 respectively via oil passages 31, 32, and 33 respectively.

Oil supplied to the crankshaft bearings 11, 12, 13, and 14 is returned to the oil sump (not shown) through return oil passages 45 which pass through the crankshaft (not shown). Crankshaft bearings 12 and 13 require more oil than crankshaft bearings 11 and 14 because they each supply two return oil passages 45 whereas crankshaft bearings 11 and 14 each supply one return oil passage 45. In addition, crankshaft bearing 12, the thrust bearing, also supplies oil to two additional oil passages (not shown) for a total of four return oil passages. Oil in the oil sump proceeds through the oil pump (not shown) to the oil filter (not shown) and finally reentering the lubrication circuit at inlet passage 5.

Figure 2:
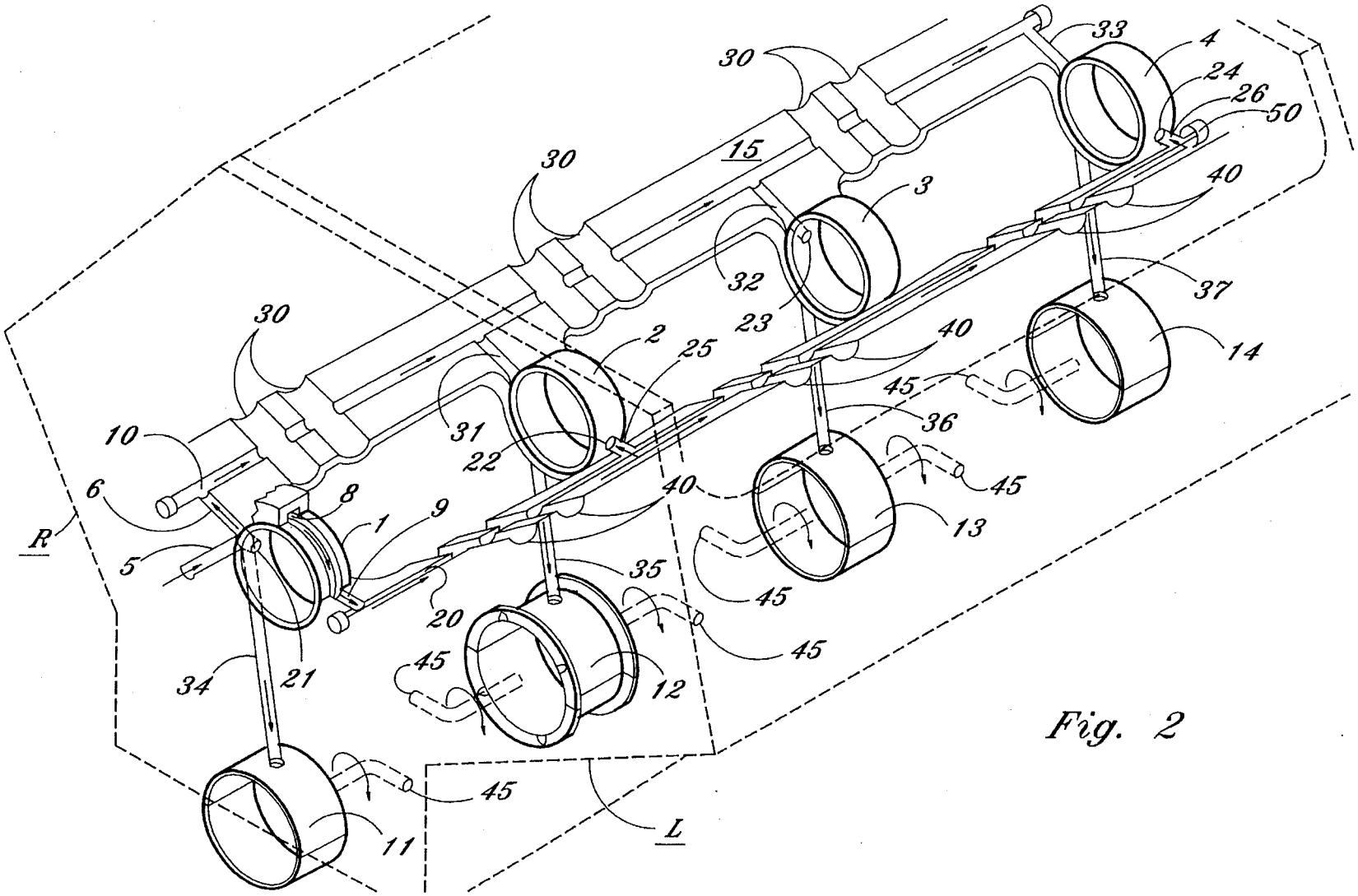
FIG. 2 is a perspective view of the improved semi-ring circuit device for a six cylinder 90 degree V-block, cam in block, General Motors internal combustion engine.

FIG. 2 discloses the instant improvement over the prior lubrication circuit. The new semi-ring lubrication circuit operates as the prior lubrication circuit described in FIG. 1 with the improvement comprising the following.

Referring to FIG. 2, two new apertures or bores are provided in the engine V-block 15, one between left side oil passage 20 and cam bearing 2 and one between left side oil passage 20 and cam bearing 4. The two apertures or bores form new oil passages 25 and 26. Cam bearing 2 is rotated to match port 22 with oil passage 25. Cam bearing 4 is rotated to match port 24 with oil passage 26. Left side oil passage 20 now supplies oil to lifter bores 40 and cam bearings 2 and 4. Left side oil passage 20 now maintains a continuous flow of oil because it supplies oil to cam bearings 2 and 4 in addition to left side lifter bores 40.

After rotation of cam bearings 2 and 4, right side oil passage 10 continues to supply oil, through oil passages 31 and 33 and interconnected oil passages 35 and 37 respectively, to crankshaft bearings 12 and 14 respectively. Right side oil passage 10 also continues to supply oil to the right side lifter bores 30, cam bearing 3 through oil passage 32 and port 23, and crankshaft bearing 13 through oil passage 36 and interconnected oil passage 32.

The overall oil supply requirements of right side oil passage 10 are reduced because cam bearings 2 and 4 are now supplied by left side oil passage 20. Right side oil passage 10 can now provide additional oil to crankshaft bearings 12 and 13. Crankshaft bearings 12 and 13 require more oil than crankshaft bearings 11 and 14 because crankshaft bearing 12 supplies four and crankshaft bearing 13 supplies two return passages 45 whereas crankshaft bearings 11 and 14 each only supply one return passage 45.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A semi-ring lubrication circuit device for a V-block, cam in block, internal combustion engine comprising:

an internal combustion V-block having a front, a back, a right side, and a left side;

an inlet oil passage formed in said V-block at said front;

a right side oil supply passage formed in said V-block and extended substantially the entire length of said V-block on said right side and in communication with said inlet oil passage;

a first, a second, a third, and a fourth cam bearing colinearly positioned and operationally spaced from said front to said back of said V-block with said first, said second, said third, and said fourth cam bearings positioned first, second, third, and fourth nearest said front of said V-block;

said first, second, third, and fourth cam bearings each having a port means to receive oil;

a first, a second, a third, and a fourth crankshaft bearing positioned below said cam bearings and colinearly positioned and operationally spaced from said front to said back of said V-block with said first, said second, said third, and said fourth crankshaft bearings positioned first, second, third, and fourth nearest said front of said V-block;

said inlet oil passage in communication with said first cam bearing through said port means and in communication with said first crankshaft bearing through a first crankshaft interconnecting oil passage;

said first cam bearing having an oil passage groove means;

a left side oil passage formed in said V-block and extended substantially the entire length of said V-block on said left side and in communication with said inlet oil passage through said first cam bearing oil passage groove means;

said left side oil passage in communication with said second cam bearing through said port means and through a second cam interconnecting oil passage formed in said V-block;

said left side oil passage in communication with said fourth cam bearing through said port means and through a fourth cam interconnecting oil passage formed in said V-block;

six left side lifter bores in communication with said left side oil passage;

said right side oil passage in communication with said third cam bearing through said port means and through a third cam interconnecting oil passage formed in said V-block and in communication with said third crankshaft bearing through a third crankshaft interconnecting oil passage formed in said V-block;

said right side oil passage in communication with said second crankshaft bearing through a second crankshaft interconnecting oil passage formed in said V-block;

said right side oil passage in communication with said fourth crankshaft bearing through a fourth interconnecting oil passage formed in said V-block;

six right side lifters bores in communication with said right side oil passage.

2. A semi-ring lubrication circuit device for a 90 degree, V-block, cam in block, General Motors type internal combustion engine having a front, a back, a right side, and a left side;

an inlet oil passage formed in said V-block at said front;

a right side oil supply passage formed in said V-block and extended substantially the entire length of said V-block on said right side and in communication with said inlet oil passage;

a first, a second, a third, and a fourth cam bearing colinearly positioned and operationally spaced from said front to said back of said V-block with said first, said second, said third, and said fourth cam bearings positioned first, second, third, and fourth nearest said front of said V-block;

said first, second, third, and fourth cam bearings each having a port means to receive oil;

a first, a second, a third, and a fourth crankshaft bearing positioned below said cam bearings and colinearly positioned and operationally spaced from said front to said back of said V-block with said first, said second, said third, and said fourth crankshaft bearings positioned first, second, third, and fourth nearest said front of said V-block;

said inlet oil passage in communication with said first cam bearing through said port means and in communication with said first crankshaft bearing through a first crankshaft interconnecting oil passage;

said first cam bearing having an oil passage groove means;

a left side oil passage formed in said V-block and extended substantially the entire length of said V-block on said left side and in communication with said inlet oil passage through said first cam bearing oil passage groove means;

said left side oil passage in communication with six left side lifter bores;

said right side oil passage in communication with said second cam bearing through said port means and through a second cam interconnecting oil passage formed in said V-block and in communication with said second crankshaft bearing through a second crankshaft interconnecting oil passage formed in said V-block;

said right side oil passage in communication with said third cam bearing through said port means and through a third cam interconnecting oil passage formed in said V-block and in communication with said third crankshaft bearing through a third crankshaft interconnecting oil passage formed in said V-block;

said right side oil passage in communication with said fourth cam bearing through said port means and through a fourth cam interconnecting oil passage formed in said V-block and in communication with said fourth crankshaft bearing through a fourth crankshaft interconnecting oil passage formed in said V-block;

six right side lifters bores in communication with said right side oil passage;

the improvement comprising:

providing a first oil passage formed in said V-block in communication with said left side oil passage and in communication with said second cam bearing rotated to match said port means with said first oil passage;

providing a second oil passage formed in said V-block in communication with said left side oil passage and in communication with said fourth cam bearing rotated to match said port means with said second oil passage.

* * * * *